US005652420A

United States Patent [19]

Innes et al.

[11] Patent Number: 5,652,420

[45] Date of Patent: Jul. 29, 1997

[54] MODULAR CONTACTOR CONTROL SYSTEM

[75] Inventors: Mark E. Innes, Asheville; Nelson R. Palmer, Arden, both of N.C.

[73] Assignee: Eaton Corporation, Cleveland, Ohio

[21] Appl. No.: 558,634

[22] Filed: Nov. 14, 1995

[51] Int. Cl.[6] ..... H01H 9/00

[52] U.S. Cl. ..... 200/50.32; 200/307; 335/132; 335/202; 361/729

[58] Field of Search ..... 200/50.01–50.4, 200/51 R–51.17, 17 R, 18, 293–307; 361/729, 730, 97; 335/6, 16, 132, 202

[56] References Cited

U.S. PATENT DOCUMENTS

| | | | |
|---|---|---|---|
| 4,100,517 | 7/1978 | Rodolfi | 335/132 |
| 4,149,047 | 4/1979 | Duble | 200/50.1 |
| 4,224,484 | 9/1980 | Haas et al. | 200/38 FB |
| 4,414,601 | 11/1983 | Conroy, Jr. | 361/97 |
| 4,513,181 | 4/1985 | Boysen et al. | 200/50.33 |
| 4,544,814 | 10/1985 | Butterworth et al. | 200/50.33 |
| 4,680,562 | 7/1987 | Bratkowski et al. | 335/16 |
| 4,754,246 | 6/1988 | Toda et al. | 335/6 |
| 4,760,364 | 7/1988 | Ostby | 335/132 |
| 4,766,273 | 8/1988 | Butterworth et al. | 218/40 |
| 4,791,362 | 12/1988 | Philpot | 361/730 X |
| 4,870,531 | 9/1989 | Danek | 361/93 |
| 5,162,766 | 11/1992 | Morris et al. | 335/202 |
| 5,179,503 | 1/1993 | Fouts et al. | 361/729 |
| 5,197,594 | 3/1993 | Drexler et al. | 335/132 X |
| 5,483,212 | 1/1996 | Lankuttis et al. | 335/132 |

*Primary Examiner*—J. R. Scott
*Attorney, Agent, or Firm*—Larry G. Vande Zande

[57] ABSTRACT

An improved contactor control system comprising several modules, such as a contactor module, an overload/controller module, a communication module, a bell alarm module, and a power terminal module which are electrically interconnected through a plug-in unit, and mechanically interconnected through one or more snap-in units, and which modules can be interchangeable and arranged relative to the overload/controller module according to a particular industrial application.

17 Claims, 8 Drawing Sheets

FIG.3A
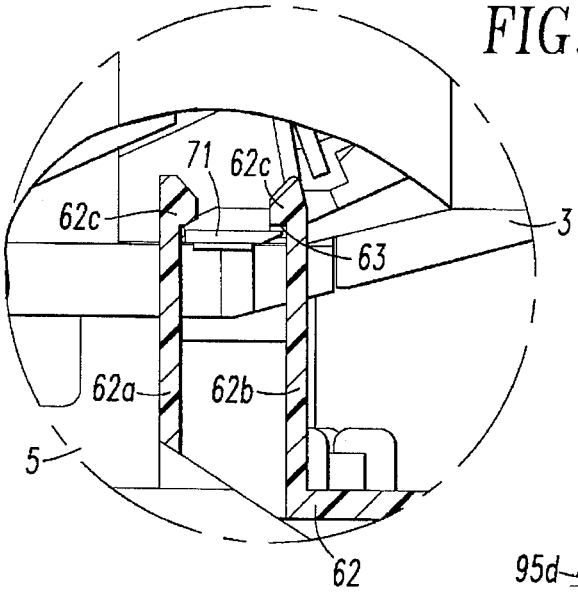
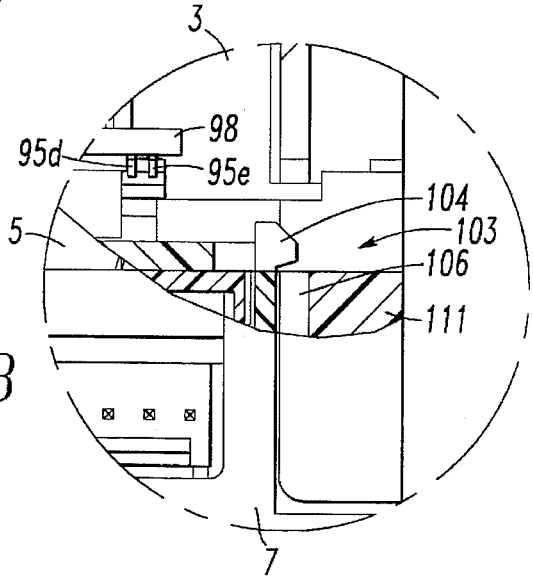
FIG.3B
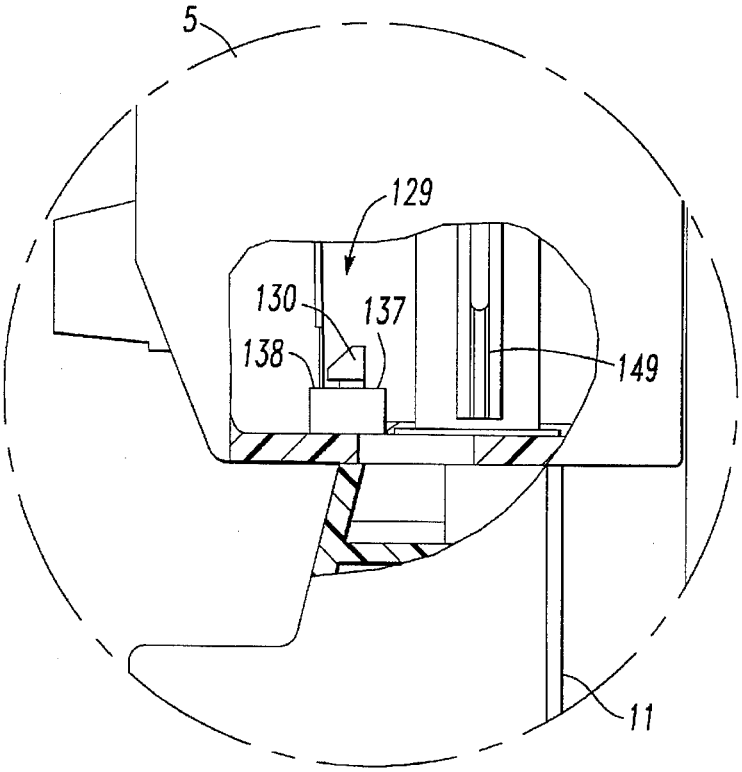
FIG.3C

FIG.5
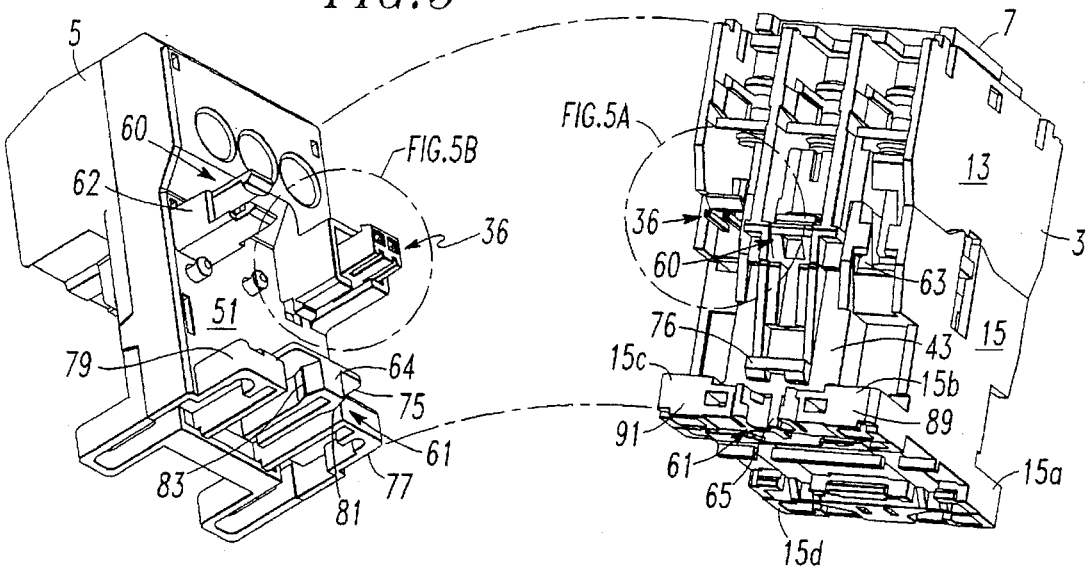
FIG.5B
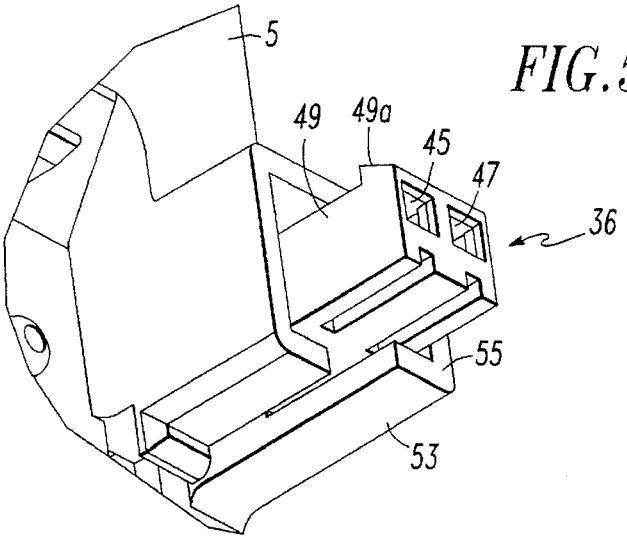
FIG.5A
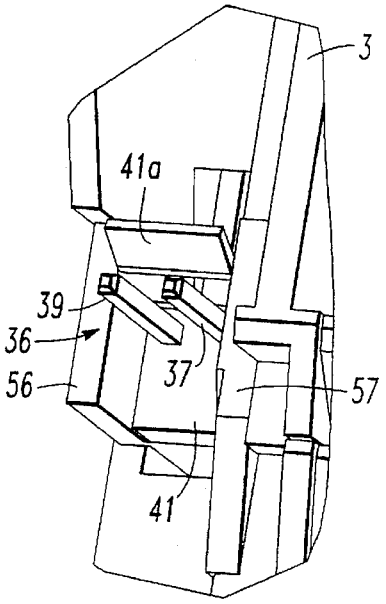
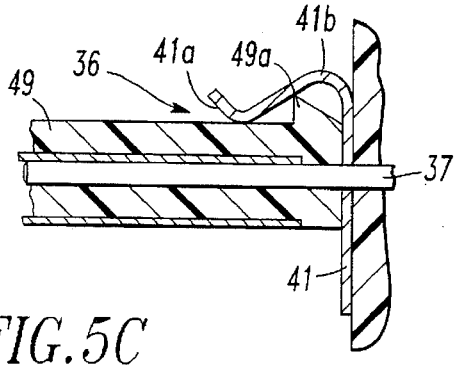
FIG.5C

FIG. 8
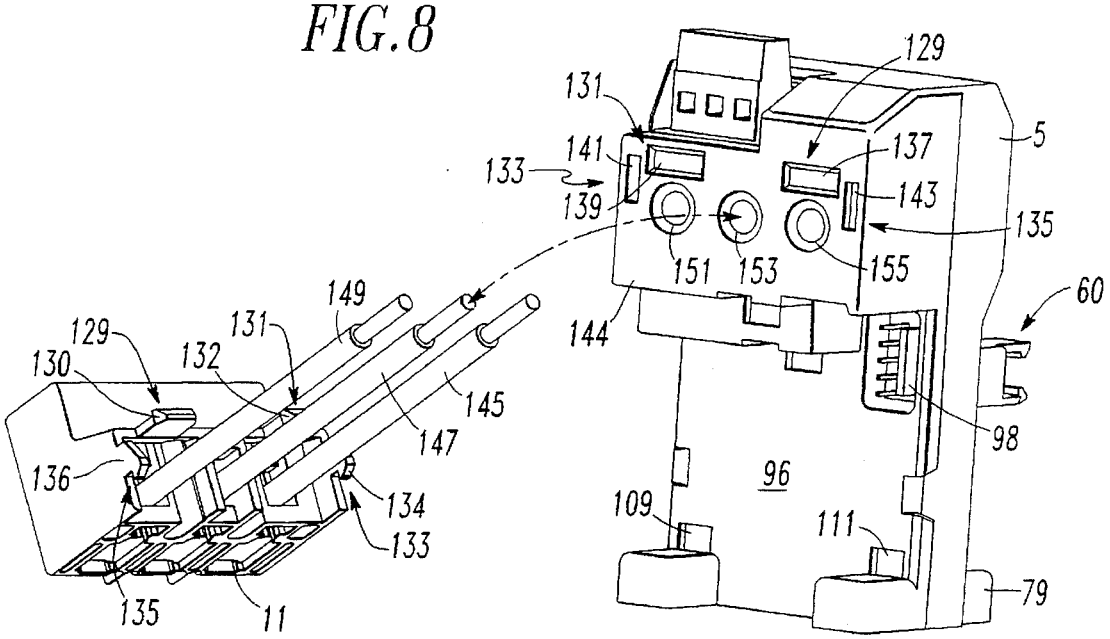
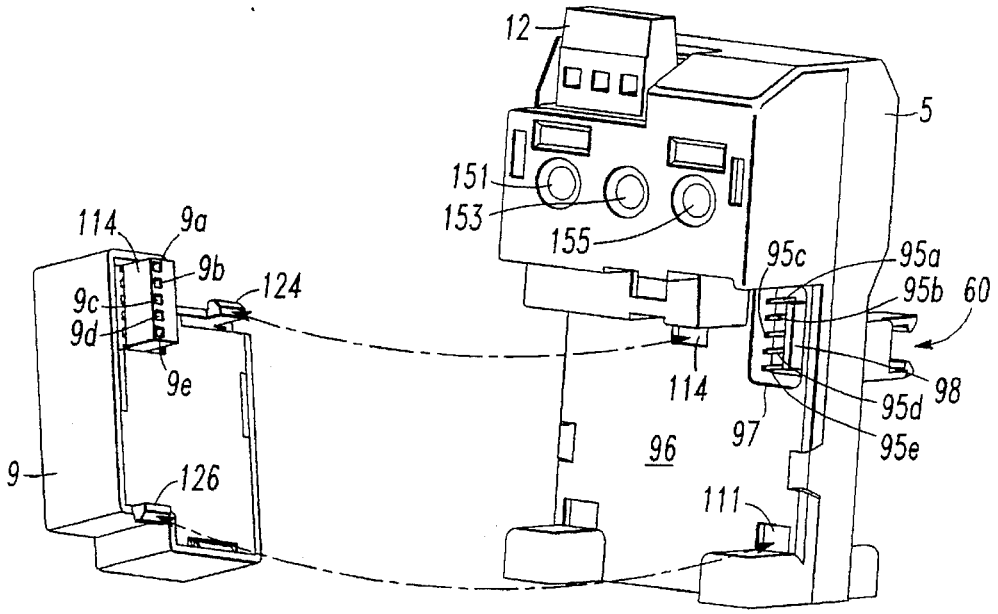
FIG. 9

MODULAR CONTACTOR CONTROL SYSTEM

BACKGROUND OF THE INVENTION

1. Field of the Invention

This invention relates to an improved contactor control system, and more particularly, it relates to several modular units for a contactor control system which easily interconnect both electrically and mechanically to a main contactor module and to each other.

2. Description of the Prior Art

Generally, a contactor control system controls the energization of a load for a power source, such as a three phase motor with several horsepower ranges which may go as high as 600 volts. This contactor control system is comprised of several components, such as a contactor, a starter protector or an overload unit, a controller, a communication unit, a display unit, and a push button unit.

As is well known in the art, a contactor contains a relay to open or close a circuit. A starter protector, commonly known as an overload unit, provides protection for an overload current as well as phase loss and/or unbalance. A controller turns the contactor on and off. A communication unit communicates with the controller. The display unit provides a visual indication of the status of the controller, and the push button station allows human interface to the controller.

A contactor with a motor controller is an electromagnetic coil which acts as a switch for connecting a motor to a device for operating the device. Generally, a conventional type of contactor with a motor controller may have one or more of the following features: a means for protecting the motor from overheating and from phase and/or current unbalance or loss, a trip setting adjustment, a test function, a bell alarm function, which is a NO/NC relay indicating the state of the trip or that there is an overload, and a reset function which provides a reset from the tripped status.

Recently, a more advanced contactor control system with a motor controller has been developed having the capability of incorporating one of more of the several features of the conventional type of contactor with a motor controller discussed in the preceding paragraph and, additionally, has the capability of incorporating a communication system which consists of a computer and adding one or more external control options. These external control options, while being an improvement over the conventional type of contactor with a motor controller discussed in the preceding paragraph, are generally poorly organized, increase the size of the contactor control system, overlap in their functions and the services they provide, and require an extensive cabling system which generally extends over the hinges of the door providing access to the housing of the contactor control system.

In some of the present-day contactor control systems, the overload module may be connected mechanically to the contactor through a snap connection means, but no electrical connection is made therebetween, thereby requiring several cable lines and wiring. All of these contactor control systems generally place the protection units closest to the overload module, followed by the control modules, and followed by the communication and display modules. Some disadvantages of this organization for the several modules for a contactor control system are the increased assembly costs and the increase in the wire and cable connections. These present-day contactor control systems also require that each component be individually mounted to a mounting panel or on a rail and interconnected electrically through a network of cables and/or wires which are also carried by the mounting panel or rail. This system requires a great amount of space and time in the assembling of these several components onto the mounting panel or rail.

There remains, therefore, a very real and substantial need in the art to provide an improved contactor control system which eliminates one or more of the several disadvantages associated with the conventional type of contactor control system.

SUMMARY OF THE INVENTION

The present invention has met the above-described needs. The present invention provides a contactor control system which comprises a plurality of functional modules, such as a contactor module, a combination overload/controller module, a communication module, a bell alarm module, and a power terminal block module which are electrically interconnected through one or more plug-in units provided on an upperside or an underside of each module, and which may be mechanically interconnected through one or more snap-in units provided on an upperside or an underside of each module. These modules may have an outer peripheral configuration which corresponds to that of the underside of its adjacent module so that it can easily be fitted to be nearly nested therein. These modules may be interchangeable and can be arranged relative to the overload/controller module according to a particular industrial application.

Only the contactor module need be securely fastened to a mounting panel on a vertical post in an enclosure with the overload/controller module being suspended from the contactor module and the remaining modules being suspended from each other by way of their plug-in units and snap-in units.

The plug-in units have a plurality of electrical connectors for exchanging logic signals for the overload/controller module to identify the optional function module and for sending information back and forth between the overload/controller module and the optional function module in order to operate these modules according to their intended purpose based on the operational conditions in the contactor control system.

It is, therefore, an object of the present invention to provide an improved contactor control system having a plurality of modules which can easily and selectively be interconnected electrically in a minimum amount of mounting panel space.

It is a still further object of the present invention to provide an improved contactor control system having a contactor module and an overload/controller module whereby the remaining modules can be selectively interchangeable and easily assembled thereto.

It is a further object of the present invention to provide a modular system for a contactor control system which eliminates or decreases an extensive network of cables and/or wires.

It is a still further object of the present invention to provide a modular contactor control system wherein the optional control modules can selectively be arranged closest to and the optional display modules can selectively be arranged farthest from the contactor module and/or the overload/controller module at least operationally, if not physically.

BRIEF DESCRIPTION OF THE DRAWINGS

A full understanding of the invention can be gained from the following description of the preferred embodiments when read in conjunction with the accompanying drawing in which:

FIG. 3A is an enlarged view of the circle indicated as "FIG. 3A" in FIG. 3;

FIG. 3B is an enlarged view of the circle indicated as "FIG. 3B" in FIG. 3;

FIG. 3C is an enlarged view of the circle indicated as "FIG. 3C" in FIG. 3;

FIG. 5 is an exploded, perspective view of the contactor and overload/controller of FIG. 4 where these modules are rotated in order to illustrate the electrical and mechanical connections between these modules;

FIG. 5A is an enlarged view of the circle indicated as "FIG. 5A" in FIG. 5;

FIG. 5B is an enlarged view of the circle indicated as "FIG. 5B" in FIG. 5;

FIG. 5C is a fragmented cross-sectional view of the plug-in unit of FIGS. 5A and 5B when in engagement;

FIG. 8 is an exploded, perspective view of the overload/controller and the power terminal block of FIG. 1 where these modules are rotated to illustrate the electrical and mechanical connections between these modules;

FIG. 9 is an exploded, perspective view of the overload/controller and the bell alarm module of FIG. 1 where these modules are rotated to illustrate the electrical and mechanical connections between these modules and showing the bell alarm module as being interchangeable with the communication module relative to the overload/controller.

DETAILED DESCRIPTION OF THE PREFERRED EMBODIMENT

Figure 1:
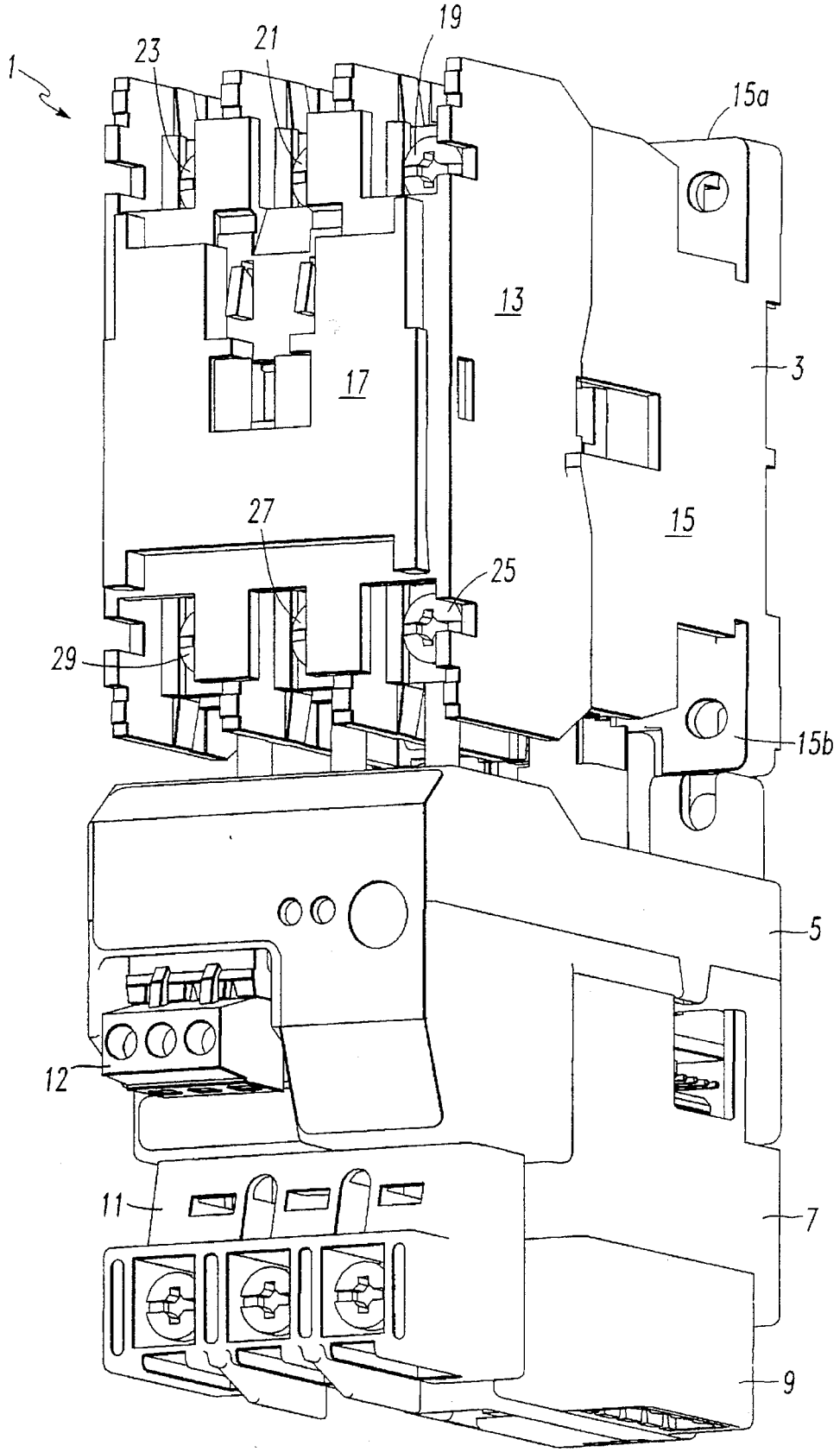
FIG. 1 is a perspective view illustrating the several modules of the contactor control system of the present invention in assembled form.

Referring to FIGS. 1–4, there is shown a contactor control system 1 in accordance with the present invention. As shown therein, contactor control system 1 comprises a contact module 3, an overload/controller module 5 connected to the contactor module 3, a communication module 7 (FIGS. 1, 3, and 4) connected to the overload/controller module 5, a bell alarm module 9 (FIGS. 1, 3, and 4) connected to the communication module 7, a power terminal block module 11 and a surge suppressor module 12 both connected to the overload/controller module 5.

Figure 2:
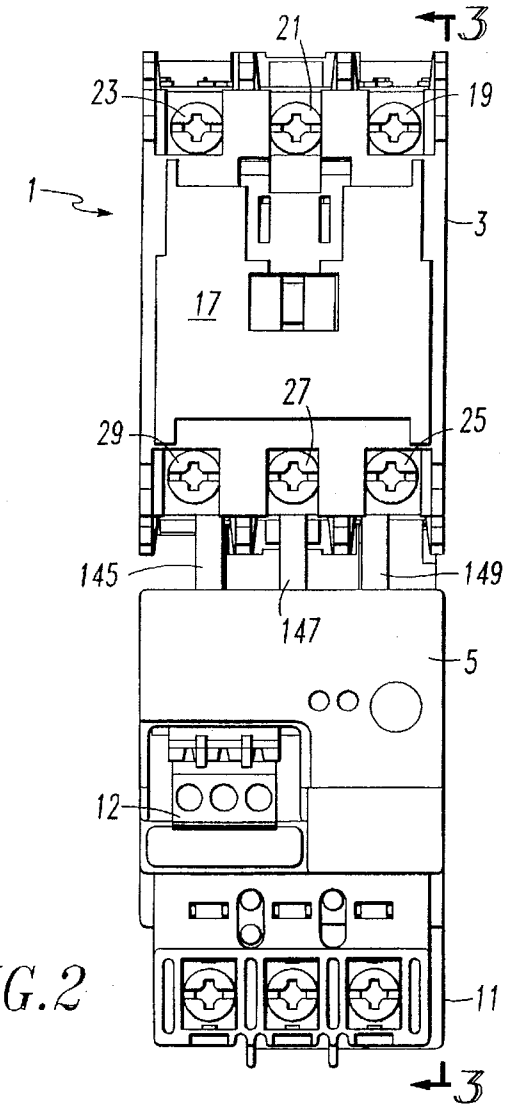
FIG. 2 is a front elevational view of the contactor control system of FIG. 1 on a smaller scale.

Contactor module 3 is, preferably, an electromagnetic contactor of the type disclosed in U.S. Pat. No. 4,760,364 which issued on Jul. 26, 1988 to Marvin E. Ostby, and which is assigned to the Eaton Corporation, which is the same assignee as this application. This U.S. Pat. No. 4,760,364 is incorporated herein by reference. The electromagnetic contactor module 3 is basically comprised of an upper housing 13, a lower housing 15, and a removable cover 17 over upper housing 13. Upper housing 13 has line terminals 19, 21, 23, and load terminals 25, 27, 29 of the three pole contacts, the line terminals 19, 21, 23 being to the top of upper housing 13 and the load terminals 25, 27, 29 being to the bottom of upper housing 13 as shown in FIGS. 1 and 2. The three sets of contacts or poles are connected between terminals 19–25, 21–27, and 23–29, and each pole includes a stationary and a movable contact (not shown) which are constructed and which operate in a conventional manner in contactor module 3, which may be as that disclosed in the aforesaid U.S. Pat. No. 4,760,364.

Figure 4:
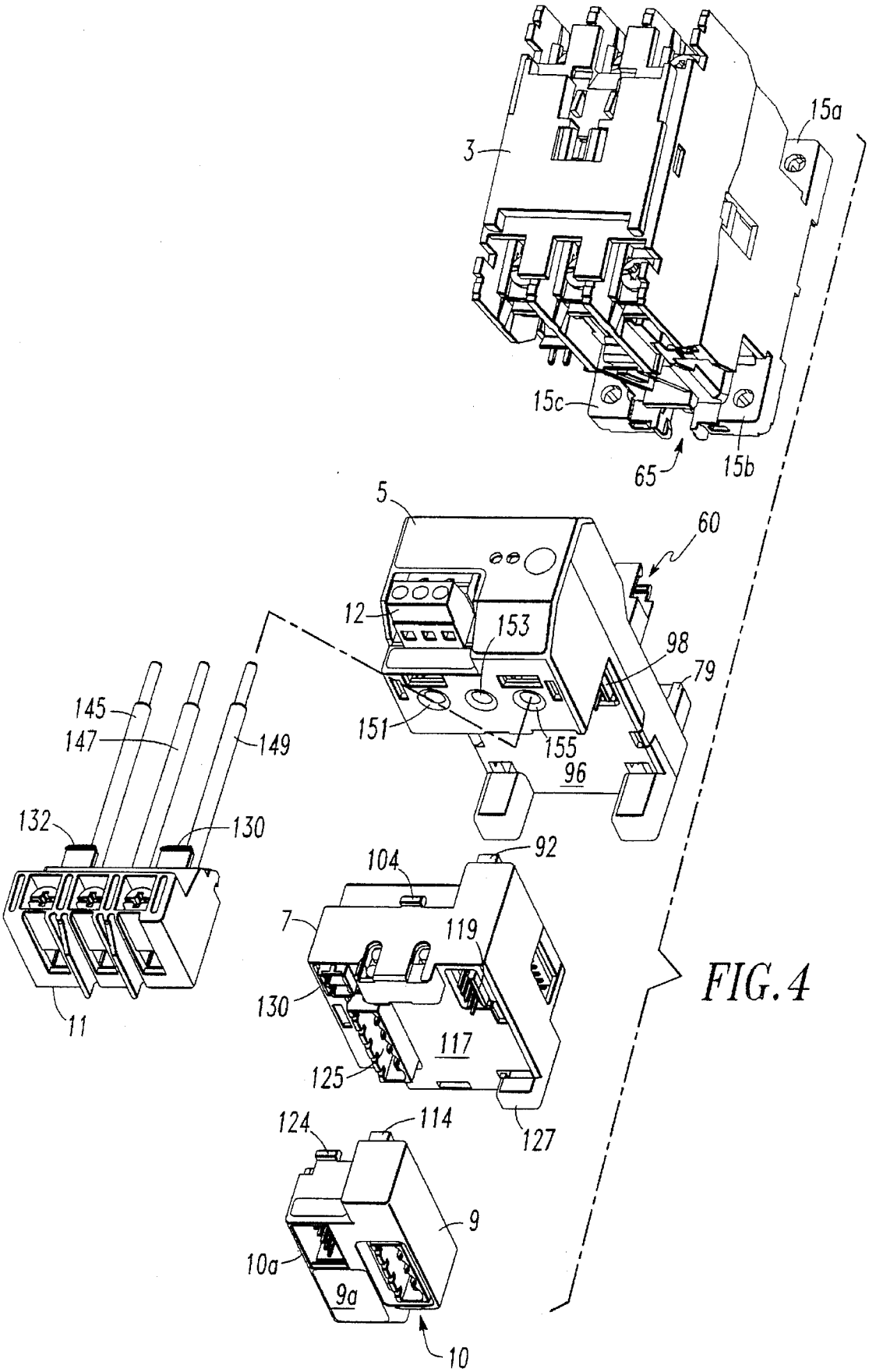
FIG. 4 is an exploded, perspective view of the several components of the contactor control system shown in FIG. 2.

Referring particularly to FIGS. 4 and 5, contactor module 3 may be physically secured to a mounting panel (not shown) by way of several screws which fit into a hole location as shown in FIG. 5 in each base corner 15*a*, 15*b*, 15*c*, and 15*d* of lower housing 15, three of which holes are particularly indicated at numerals 31, 33, and 35 in FIG. 4.

As is well known in the art, the mounting panel (not shown) which may carry the contactor control system is secured in an enclosure which has a door for accessing the mounting panel and which may be mounted on a vertical support for its industrial application.

Referring to FIGS. 5, 5A, 5B, and 5C, an electrical connection between contactor module 3 and overload/controller module 5 is made through a plug-in unit 36. Referring to FIGS. 5A and 5B, plug-in unit 36 comprises metal pins 37 and 39 protruding through a rectangular base 41 on the underside 43 (FIG. 5) of contactor module 3 and corresponding ports 45 and 47, respectively of a projection dement 49 on an upperside 51 (FIG. 5) of overload/controller module 5. Projection element 49 is mounted in a rectangular aperture 53 and has a peripheral end surface 55 which abuts against corresponding peripheral end surfaces 56 and 57 surrounding base 41 on contactor module 3 when metal pins 37 and 39 are positioned in their respective ports 45, 47 of projection element 49 for the electrical connection of modules 3 and 5. With particular reference to FIG. 5C, base 41 has a resilient portion 41*a* with an engaging portion 41*b* for engaging a protruded portion 49*a* on projection element 49 for a snap-in mechanical connection of projection element 49 of overload/controller module 5 to contactor module 3.

Metal pins 37 and 39 are either input, output or a serial communications port and ports 45 and 47 each contain a contact member connected to a wire extending through projection element 49 and into overload/controller module 5.

Still referring to FIG. 5, further mechanical interlocking between contactor module 3 and overload/controller module 5 is attained through resilient snap-in means 60 and 61 which have projecting means 62 and 64 also located and projecting outwardly from the upperside 51 of module 5 and which projecting means 62 and 64 are retained in slot means 63 and 65, respectively, located on the underside 43 of contactor module 3.

Figure 3:
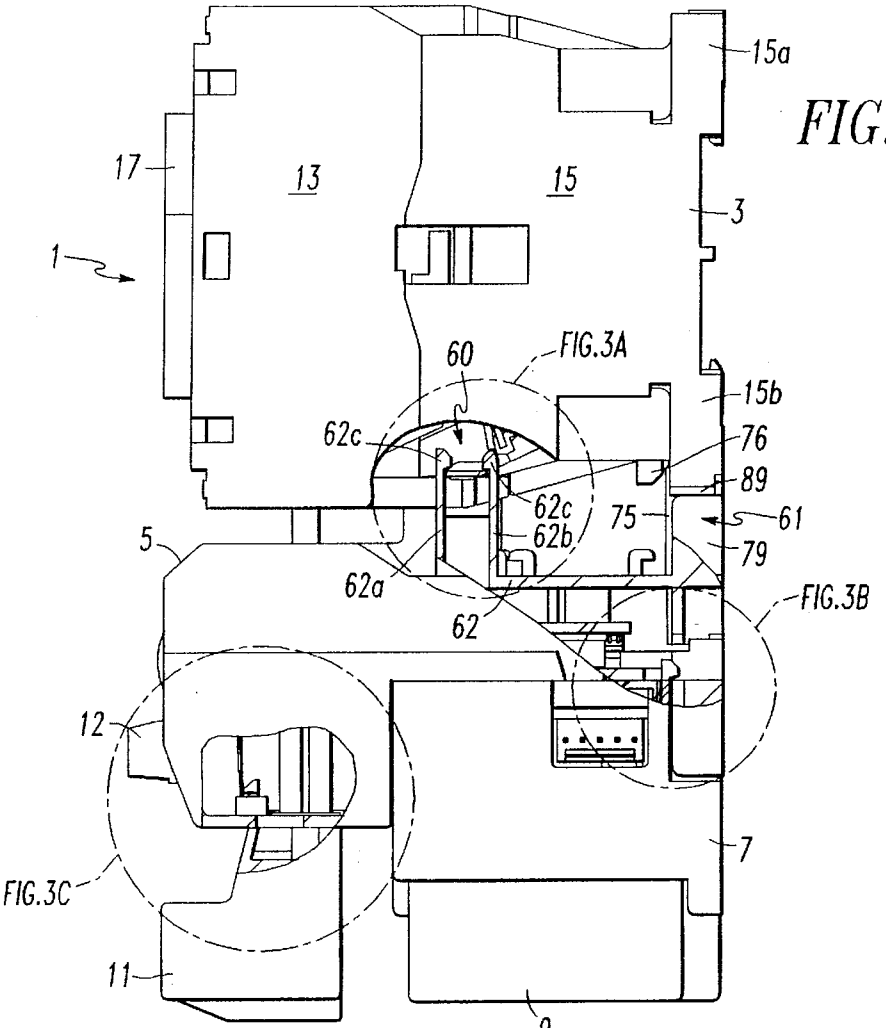
FIG. 3 is a vertical view taken along lines 3—3 of FIG. 2 showing fragmented sectional views of some of the mechanical connections between each of the several modules of the present invention.

With particular reference to FIGS. 3, 3A and 5, projecting means 62 on overload/controller module 5 comprise resilient mounting legs 62*a* and 62*b*, each of which has a hook 62*c* and which hooks 62*c* cooperate to engage a ledge 71 formed in slot means 63 of contact module 3.

This engagement of hooks 62c relative to ledge 71 is best illustrated in FIG. 3A.

With particular reference to FIG. 5, snap-in means 61 comprises an inner resilient projection means 64 and resilient elongated outer members 77 and 79, each spaced away from inner means 64. Inner means 64 has a flat base 75 and engaging protruding surfaces 81, 83 on its opposed sides which extend beyond the end surfaces of outer members 77 and 79 so as to fit up into slot 65 to engage corresponding engaging surfaces in slot means 65 of contactor module 3, and whereby the end surfaces of the outer members 77 and 79, respectively abut against and are flush with end surfaces 89, 91 of base corners 15b and 15c of lower housing 15 of contactor module 3. This abutment is shown in FIG. 3 for outer member 79 against surface 89 of base corner 15b. When inner means 64 is engaged in slot means 65, flat base 75 fits in between slot means 65 and a stop member 76 which is on the underside 43 of module 3 and best shown to the right of FIGS. 3 and 5.

As can be appreciated from the preceding and from FIG. 3, overload/controller module 5 is vertically positioned beneath and securely hangs from contactor module 3 by way of mechanical snap-in means 60 and 61 and the plug-in unit 36 of these modules 3 and 5 in a stabilized manner. In addition to the mechanical connection being made therebetween by way of snap-in means 60 and 61, it is also made by way of the engaging elements of plug-in unit 36 as shown in FIG. 5C, which plug-in unit 36 provides the electrical connection between contactor module 3 and overload controller 5.

Figure 6:
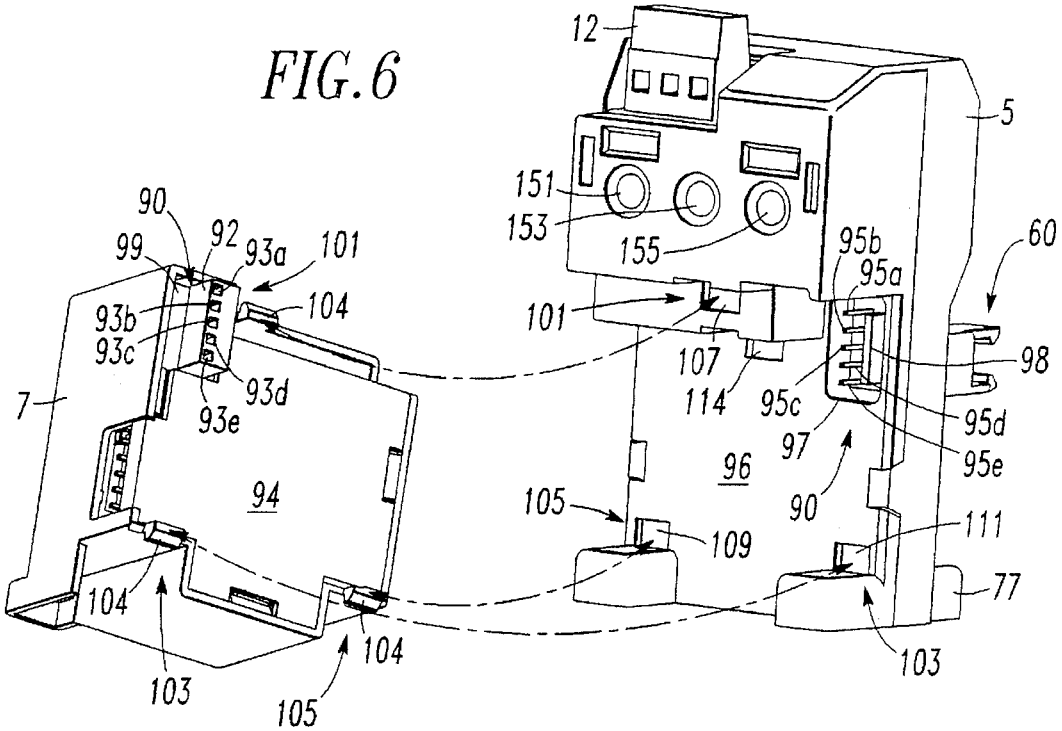
FIG. 6 is an exploded, perspective view of the overload/controller and the communication module of FIG. 1 where these modules are rotated in order to illustrate the electrical and mechanical connections between these modules.

Referring now to FIG. 6, an electrical and mechanical connection between overload/controller module 5 and communication module 7 are made by way of a plug-in unit 90 comprising a projection 92, which projects out of the underside 94 of communication module 7 and which has a plurality of ports 93a, 93b, 93c, 93d, and 93e and a plurality of metal pins 95a, 95b, 95c, 95d, and 95e on an underside 96, wherein metal pins 95a–95e are received in ports 93a–93e, respectively when communication module 7 is assembled onto module 5. Pins 95a–95e are recessed in a rectangular aperture 97 and has a projecting wall 98. Projection 92 of module 7 is located in an aperture 99. When communication module 7 is assembled onto the underside 96 of overload module 5, pins 95a–95e are received in ports 93a–93e and the walls of projection 92 frictionally engage the wall member 98 in aperture 97 of module 5 and the opposing wall of aperture 97 to electrically and mechanically hold modules 5 and 7 together.

Further mechanical interlocking of communication module 7 to module 5 is done by way of snap-in means 101, 103, and 105, each of which consists of a resilient projecting portion 104 and slots 107, 109, and 111. Projecting portion 104 is located along the periphery of the underside 94 of module 7 and snaps into position in a corresponding slot 107, 109, and 111, respectively in the underside 96 of module 5, behind a ledge in each slot 107–111 wherein projecting portion 104 engages behind the ledge. This is best shown in FIGS. 3 and 3B where a ledge 106 of slot 111 holds projection portion 104 of snap-in means 103. As can best be seen in FIG. 6, the outer configuration of module 7 corresponds to the configuration of the underside 96 of module 5 so that module 7 is nested against and within module 5 when the control system 1 is in the assembled form of FIGS. 1–3.

Figure 7:
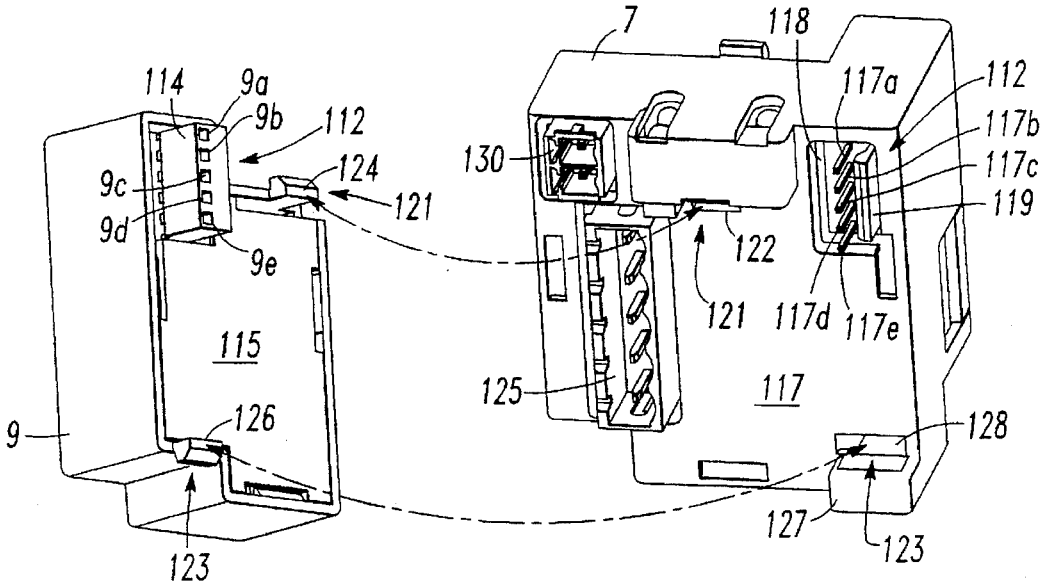
FIG. 7 is an exploded, perspective view of the communication module and the bell alarm module of FIG. 1 where these modules are rotated to illustrate the electrical and mechanical connections between these modules.

Referring to FIG. 7, an electrical and mechanical connection between module 7 and module 9 is made by way of plug-in means 112 comprising a projecting member 114, with a plurality of ports 9a, 9b, 9c, 9d, and 9e, and which member 114 projects out of an upperside 115 of module 9 and a plurality of metal pins 117a, 117b, 117c, 117d, and 117e, extending from an aperture 118 on an underside 119 of module 7, whereby pins 117a–117e are received in ports 9a–9e, respectively when module 9 is assembled onto module 7. A wall member 119 projects out of aperture 118 spaced away from pins 117a–117e. When module 9 is assembled onto the underside 117 of module 7, pins 117a–117e enter their respective ports 9a–9e and projecting member 114 frictionally engages wall member 119 of aperture 118 of module 7 and the opposing wail in aperture 118 for an electrical and mechanical connection between modules 7 and 9.

Further mechanical interlocking of module 9 to module 7 is done via snap-in means 121 and 123 comprising resilient projecting members 124 and 126 located along the upperside 115 of module 9, and slots 122 and 128 on the underside 117 of module 7. Each projecting member 124 and 126 engages and is held in position behind a ledge in its respective slot 122, 128 in a manner similar to that discussed for snap-in means 103 and shown in FIG. 3B.

To the left of module 7 on its underside 117 with regard to FIG. 7, there are electrical connection means 125 and 130 for the connection of further optional modules, which are not shown in any of the drawings, but which are known to those skilled in the art.

As shown in FIG. 7, the outer configuration of module 9 corresponds to the configuration of the area on underside 117 between electrical connection means 125, rectangular aperture 118, and a leg 127 so that module 9 can be nearly fitted against and within module 7 when the control system 1 of the invention is in the assembled form of FIGS. 1–3. FIG. 4 shows that the underside 9a of module 9 has further electrical connection element means 10 and 10a for additional optional modules.

Referring now to FIG. 8, the mechanical interlocking of power terminal module 11 to overload/controller module 5 is done via several resilient snap-in means 129, 131, 133, and 135. Snap in means 129, 131, 133 and 135 comprise projecting resilient elements 130, 132, 134, and 136, respectively of module 11 which are received in slots 137, 139, 141, and 143 respectively, which are formed in the underside 144 of overload/controller module 5. With particular reference to FIG. 4, elements 130 and 132 are similarly constructed and elements 134 and 136 are similarly constructed. In an obvious manner in view of the teachings hereinabove, the several slots 137–143 each has a ledge which is engaging by the hooked portions of each snap-in means 129, 131, 133, and 135 for fixedly securing block 11 to overload/controller module 5. The engagement of snap-in means 129 is best shown in FIG. 3C where the engaging head of element 130 is secured and held in place behind ledge 138 of slot 137.

As particularly shown in FIGS. 4 and 8, power terminal module 11 has a plurality of power leads 145, 147, and 149 which extend in through passageways 151, 153, 155, respectively in the cantilever portion of module 5 for their electrical connection to load terminals 25, 27, 29 respectively, as shown best in FIG. 2. Power terminal module 11 has an external configuration such that it fits nearly against the underside 144 of the cantilever portion of module 5 and is almost flush with the cantilever portion of module 5.

The passageways 151, 153, and 155 preferably, have enclosed walls so that the inside elements of module 5 are closed off and wherein an annular current sensor for each passageway 151,153, and 155 is arranged there around behind the enclosed wall and inside module 5. Each power lead 145, 147, 149 extends through their respective passageway for their electrical connection to their respective terminal 25, 27, 29 and, thus, their respective current sensor. The effect of this construction and arrangement is the operation of the relay in overload/controller module 5, whereby the high voltage and excessive wiring generally involved in prior art systems is eliminated or decreased.

As best shown in FIG. 3 power terminal module 11 depends from overload/controller module 5 and is spaced away from and extends parallel to module 9, which also is suspended from overload/controller module 5.

FIG. 9 shows a further embodiment for the control system of FIGS. 1–4 whereby module 9 can be mounted in a nested fashion within the underside 96 of overload/controller module 5. This is easily done by inserting projecting members 124 and 126 of module 9 into slots 114 and 111, respectively of module 5, and pins 95*a*–95*e* into ports 9*a*–9*e* of member 114 in an obvious manner, whereby member 114 frictionally engages wall 98 and the opposing wall in aperture 97 of module 5.

From this preceding paragraph, it is apparent that module 7 and module 9 are interchangeable and can selectively be mounted to overload/controller module 5 according to the requirements for the industrial application of the control system 1 of FIGS. 1–4.

Figure 10:
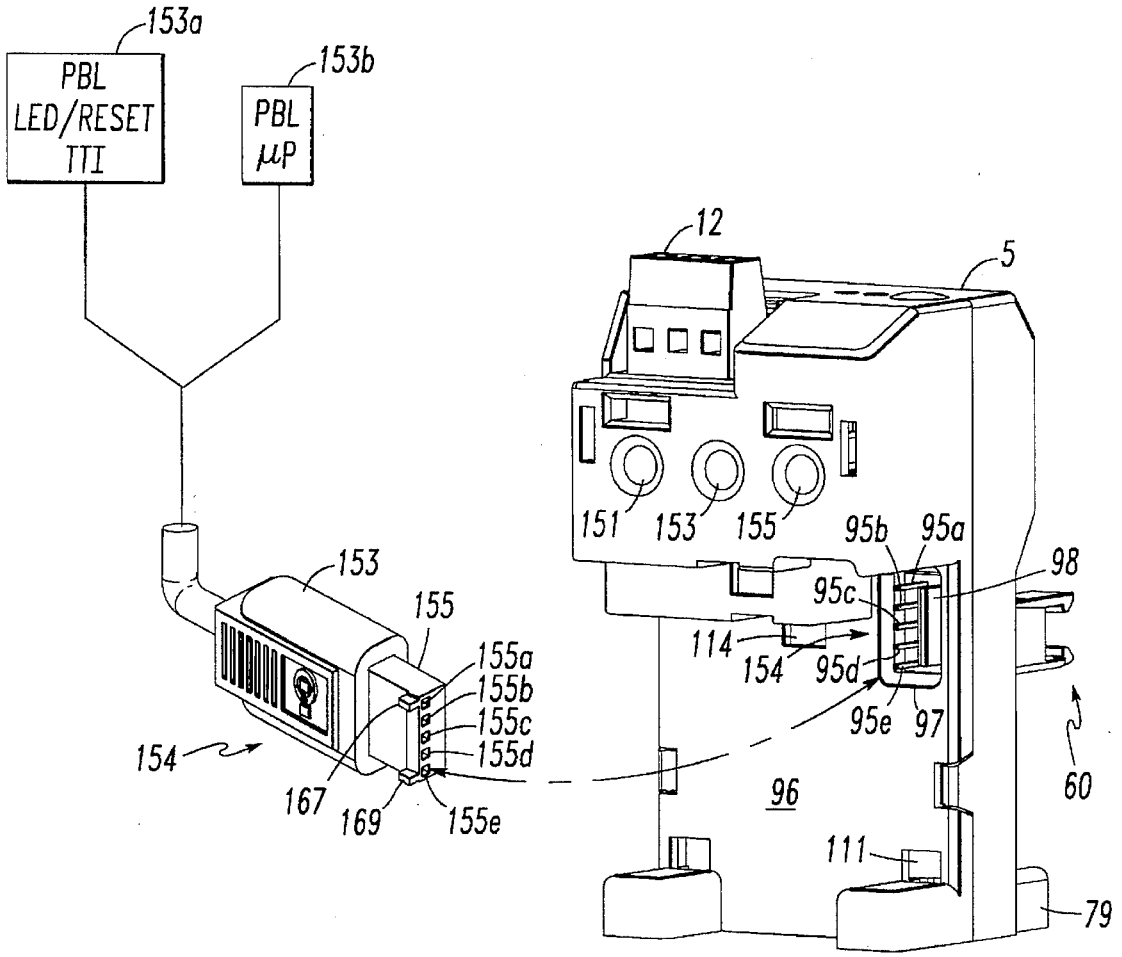
FIG. 10 is an exploded, perspective view of the overload/controller of FIG. 1 where optionally a cable module can be electrically connected to the overload/controller module.

FIG. 10 shows a a third embodiment for the control system 1 wherein a cable module 153 can optionally be plugged into overload/controller module 5. Cable module 153 has a plug-in unit 154 comprised of a rectangular projection 155 with a plurality of ports 155*a*, 155*b*, 155*c*, 155*d*, 1553*e* and engaging resilient side members 167, and 169 whereby projection 155 is inserted into rectangular aperture 97 of module 5 and side members 167 and 169 of member 155 module 153 engage ledges (not shown) in aperture 97 of module 5 with pins 95*a*–95*e* entering ports 155*a*–155*e* of module 153 in a fashion similar to that explained hereinabove.

In a similar manner, cable module 153 can be electrically and mechanically connected to module 7 and module 9 by plugging module 153 into any of the plug-in units of modules 7 and 9. Even though not shown in detail, surge suppressor module 12 has several metal pins which are inserted into ports along the front of overload/controller module 5 for its electrical and mechanical connection.

From the above, it can be appreciated that the several modules 3, 5, 7, 9, 11, and 12 for the control system 1 of FIGS. 1–4 can be easily electrically interconnected to each other through a plug-in unit which eliminates the need for an extensive network of cables and can be easily mechanically interconnected to each other through one or more snap-in units. It can also be appreciated that several of these components can be interchangeable relative to the overload/controller module 5 in order to accommodate specifications for a particular industrial application, and that other compatible modules not disclosed herein can be added to the system by means of comparable snap-in units and plug-in units. Additionally, for the control system 1 of FIGS. 1–4, in most applications, it is only necessary to mount the contactor module 3 to a mounting panel whereby the several remaining modules, such as modules 5, 7, 9, 11 and 12 can be easily added to or removed from the control system 1.

The principles and operation of modules 3, 4, 7, 9, 11 and 12 are similar to that of conventional devices, and the housing for each module 3, 4, 7, 9, and 11 is, preferably, a molded insulating enclosure generally made of a thermoplastic material.

Referring again to FIGS. 1–4, the overload controller module 5 is generally the main component for control system 1. This module may come in a single output version, or two such modules may be used for a dual output version for reversing and two speed applications. The wiring to overload/controller module 5 can be brought thereto through a separate connector module, which arrangement allows surge suppressor module 12 or loading resistors (not shown) for triac outputs to be inserted without removing individual wires, and which arrangement allows the wiring harness to be laid out long before the overload/controller module 5 is installed. Since power leads 145, 147, and 149 of terminal module 11 pass through passageways 151, 153, 155 of overload/controller module 5 to contactor module 3, the possibility that these connections become overheated, which generally occurs in the conventional type of arrangement for a control system where the terminals of the contactor are directly connected to the cables or wires of the overload/controller device, is eliminated or decreased.

With regard to overload/controller module 5, this module 5 may include programmable port means which effects the electrical connection between module 5 and module 7 or any other optional module which may be plugged into module 5. This programmable port means may include logic means for determining the function of and for operating the optional module directly connected to overload/controller module 5.

With regard to overload/controller module 5, preferably, this module 5 contains a microprocessor which interfaces with the communication module 7 or any other optional module which may be physically and/or directly connected to overload module 5. This is done through means 95*a* through 95*e* would include the logic for determining the function of the module directly connected to the overload/controller module 5 and to operate this functional module accordingly.

For example, from the above it is understood that either a communication module 7, a bell module 9, or a cable module 153 can be directly attached to overload module 5 as shown in FIGS. 6, 9, and 10 respectively, where cable module 153 can be used to electrically connect a remote unit 153*a* which can contain discrete logic devices such as a discrete logic push button logic device (PBL), a trip type indicator device (TTI), or an LED/reset device, all of which devices require a cable connection to overload module 5, or alternately, the cable module 153 can be used to electrically connect a remote unit 153*b*, such as a push button logic device which may contain a microprocessor, and whereby overload module 5 can easily communicate with the microprocessor of this remote unit 153*b*.

The system of the invention as will be explained further with reference to Tables 1 through 4 works on logic level signals which will be based on either high (H) or low (L) voltages. On power up, the microprocessor of overload module 5 looks at the pin connections and referring to Table 1, pin 95*c* is referred to as number 3, pin 95*d* is referred to as number 4, and pine 95*e* is referred to as number 5 of module 5 in order to see what device is connected to module 5, or no device may be connected to overload module 5.

In the initial start up or power up conditions for the system of the invention, and with reference to Table 1, if pins 3,4, and 5 read L,L,L, then the microprocessor of overload module 5 is connected to a device labelled "Unspecified" which as indicated in Table 2 could be a trip type indicator or an LED/reset unit of remote unit 153*a* connected to overload module 5 through cable module 153 of FIG. 10. If pins 3,4, and 5 read L,L,H, then the microprocessor of module 5 knows that it is connected to a discrete logic push button logic device of the remote unit 153*a*, which is also connected to overload module 5 through cable module 153 of FIG. 10. If pins 3, 4, and 5 read H,L,L, then the microprocessor of module 5 will recognize this module as being the bell module 9 of FIG. 6 and therefore will operate bell module 9 accordingly. If pins 3, 4, and 5 of overload module 5 read H,H,L, then the microprocessor of module 5 recognizes the module as containing a microprocessor (uP) as indicated in column 5 of Table 1. Such a device may be the communication module 7 of FIG. 6 or a microprocessor push button logic device of remote unit 153*b* of FIG. 10. The interfacing of these various devices or modules is easily done in that the input on pins 3, 4, and 5 is changed through the microprocessor to output information which operates these modules. With regard to column 5 of Table 1, the microprocessor of overload module 5 can communicate with any module having a microprocessor without having to exchange logic signals as explained herein for Tables 1 through 4.

Table 2 gives an example of an interface between the microprocessor of overload module 5 with a device which as unspecified on start up and which may be a trip type indicator or an LED/reset device of remote unit 153*a* of FIG. 10. In this case, at least three of ports 155*a* through 155*e* are used and designated as 3,4, and 5 in Table 2. As shown in column 2 of Table 2, in the initial (INIT) stage after start up overload module 5 applies to pin connections 3, 4, and 5, L,L,L signals. As the system of FIG. 10 continues to operate, and the overload module 5 recognizes a trip condition for the contactor 3 of FIG. 1, then the input from overload module 5 to cable module 153 of FIG. 10 on pins 3, 4, and 5 will, as shown in column 3 of Table 2, be H, Hpulse, Lread, where "H" is a high logic signal, Hpulse is a pulse signal which is modulated according to the type of trip; and Lread means that pin 5 is configured by the overload module 5 as an input. If the system of FIG. 10 continues to operate with no trip occurring in contactor 3, then as shown in column 4 of Table 2, the input on pins 3, 4, and 5 will be L,L,L which is the same pattern as the initial conditions of column 2 of Table 2. If the device is a reset button, the microprocessor in overload module 5 looks for a reset signal from that device.

Table 3 presents an input section and an output section for the bell module 9 as being connected to communication module 7 of FIG. 7 or as being connected to overload module 5 of FIG. 9. Referring to FIG. 4, the input signals 3,4, and 5 into bell module 9 may be applied to three of ports 9*a* through 9*e* and the output signals may be generated by bell module 9 at 10*a*. A reset device or an LED may be connected to output 10*a* of bell module 9. As shown in column 2, in the initial (INIT) stage after start up, signals 3, 4, and 5 would be H,L,L, which is the same pattern in column 4 under "BELL", and which, therefore, is recognized by overload module 5 as being the bell module 9. This information can be directly sent to the overload module 5 according to the arrangement of FIG. 9 or it can be sent indirectly through the microprocessor of communication module 7 according to the arrangement of FIG. 7.

As the system of the arrangements of FIGS. 7 or 9 continues to operate, and the overload module 5 recognizes a trip condition as occurring in contactor 3, then the signals from overload module 5 to bell module 9 on pins 3, 4, and 5, as shown in column 3 of Table 3 will be Lread,Hpulse,L so that pin 3 is configured as an input to the microprocessor of module 5, Hpulse is a signal which is modulated according to the type of trip, and pin 3 remains low. If the arrangement of FIG. 7 or 9 encounters an overload condition, but a trip has not yet occurred, as indicated in column 4 for the input to the bell module 9, then pins 3, 4, and 5 will be H,L,Hpulse where Hpulse is modulated according to the overload condition.

Still referring to Table 3, a reset device or an LED device may be connected to the output of unit 10*a* for bell module 9 through cable module 153 of FIG. 10. In the initial stage (INIT) after power up, as indicated in column 2, pins 1,2, and 3 may be L,H,H for the communication of bell module 9 with cable module 153 of FIG. 10. If an LED/reset device is connected to cable module 153, which, in turn, is plugged into unit 10*a* of bell module 9, and if a trip occurs in contactor 3, then pins 1, 2, and 3 would be H,H,Lread. If there is an overload, then as column 4 indicates the output signals on pins 1, 2,and 3 would be Lopen, H,H to cable module 153, and therefore to the LED/reset device 153*a*.

Table 4 provides the various signals for the discrete logic push button logic device identified according to column 3 in Table 1, which push button logic device, as discussed hereinabove, may be part of the remote unit 153*a* attached to cable module 153 of FIG. 10, and which cable module 153 may be plugged directly into overload module 5 as shown in FIG. 10. Three of the five ports 155*a*–155*e* of cable module 153 would be designated as 3reset/run, 4feedback, and 5trip as shown in column 1. The 3reset/run may be a signal from the push button logic device to the overload module 5, and 4feedback and 5trip may be signals from the overload module 5 to cable device 153. In the initial stage after the power up stage, the signals would be X,L,H as indicated in column 2, where "X" could be a high or a low voltage. If a trip occurs, then as shown in column 3, the signals are L,L,Hpulse where Hpulse again is a modulated signal to indicate the type of trip. If the system is ready, then the output signals are L,L,L as shown in column 4 for this "READY" situation. The other situations in Table 4 are "RUN", "RESET", and "START", as indicated in columns 5, 6, and 7 respectively. The signals under "RUN" are H,H,L. Those under "RESET", are H,X,Hpulse, and those under "START" are H,X,L. As an example, when the start button is pushed, pin 3 goes high. When the system starts, then the microprocessor sends a feedback signal to the "RUN" column. The microprocessor causes pin 4 to go high. When a trip occurs, pine 3 goes low and a high pulse signal is sent on pin 5. When reset button causes pin 3 to go high if resets the system to go to the "READY" state.

From the above with regard to Tables 1 through 4, it is appreciated that a set pattern of logic signals informs the overload module 5 as to the type of module it is connected to and and the overload module 5 sends logic signals to the respective module based on this information. During the operation of the particular module arrangement such as those shown in the Figures, logic signals are sent back and forth between or among the several modules to provide information regarding the conditions occurring in the system in order for the modules to function accordingly.

It is to be appreciated that communication module 7 may have different communication systems with different communication protocol therein, but the physical appearance of communication module 7 will generally remain the same.

It is to be further appreciated that the internal signals in overload module 5 allows the system to know whether the electromagnetic coil of contactor module 3 has actually opened or if it is closed, thereby eliminating the extensive electrical/mechanical feedback network which was necessary in many prior art installations. In the present invention, only the overload module 5 needs to be powered up, with the remaining electrical connections being made via mass connections.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

TABLE 1

| (1) | (2) | (3) | (4) | (5) |
|---|---|---|---|---|
| 3 | Unspecified | PBL | BELL | uP |
| 4 | L | L | H | H |
| 5 | L | L | L | H |
| | L | H | L | L |

TABLE 2

| | (1) | (2) | (3) | (4) |
|---|---|---|---|---|
| Unspecified (tti,reset,led) | | INIT | TRIP | notTRIP |
| | 3 | L | H | L |
| | 4 | L | Hpulse | L |
| | 5 | L | Lread | L |

TABLE 3

| | (1) | (2) | (3) | (4) |
|---|---|---|---|---|
| BELL INPUT | | INIT | TRIP | notTRIP |
| | 3 | H | Lread | H |
| | 4 | L | Hpulse | L |
| | 5 | L | L | Hpulse |
| | | INIT | TRIP | notTRIP |
| BELL OUTPUT (reset,led) | 1 | L | H | Lopen |
| | 2 | H | H | H |
| | 3 | H | Lread | H |

TABLE 4

| | (1) | (2) | (3) | (4) |
|---|---|---|---|---|
| | | INIT | TRIP | READY |
| PBLogic | 3 reset/run | X | L | L |
| | 4 feedback | L | L | L |
| | 5 trip | H | Hpulse | L |
| | | (5) | (6) | (7) |
| | | RUN | RESET | START |
| | | H | H | H |
| | | H | X | X |
| | | L | Hpulse | L |

What is claimed is:

1. A contactor control system for operating a load, comprising: contactor module means for operating said load, overload module means associated with said contactor module means, said contactor module means and said overload module means including means for electrically and mechanically connecting said overload module means external to said contactor module means with said overload module means independently supported by said contactor module means.

2. A control system of claim 1, further comprising: optional function module means connected to said overload module means, and including means for electrically and mechanically connecting said optional function module means to said overload module means.

3. A control system of claim 2, wherein said optional function module means comprise a plurality of optional function units which are interconnectable relative to each other and relative to said overload module means.

4. A control system of claim 2, wherein said means for electrically and mechanically connecting said optional function module means to said overload module means comprises a plurality of electrical connections for exchanging logic signals and for identifying said optional function module means to said overload module means and for sending information between said optional function module means and said overload module means in order for said optional function module means and said overload module means to function based on operational conditions in said control system.

5. A control system of claim 3 wherein said overload module means comprises a plurality of plug-in means and snap-in means for electrically and mechanically interconnecting a selected number of said plurality of optional function units.

6. A control system of claim 3 wherein said plurality of optional function units include a communication module and a bell alarm module which comprise similar plug-in means and snap-in means for connecting said communication module directly to said overload module means and said bell alarm module directly to said communication module and alternately connecting said bell alarm module to said overload module means.

7. A control system of claim 6 wherein said communication module has a peripheral configuration and said overload controller module means has an underside with a configuration for accommodating said peripheral configuration of said communication module for nesting said communication module to said underside of said overload controller module means.

8. A control system of claim 6 wherein said bell alarm module has a peripheral configuration and said overload controller module means has an underside with a configuration for accommodating said peripheral configuration of said bell alarm module for nesting said bell alarm module to said underside of said overload controller module means.

9. A control system of claim 3 wherein said optional function units include resilient snap-in means for their mechanical interconnection to said overload module means and to each other.

10. A control system of claim 1, wherein said overload module means has a housing with passageway means and current sensor means associated with said passageway means for the operation of said overload module means.

11. A control system of claim 10, further comprising power terminal module means having power lead means extending through said passageway means of said overload module means for electrical connection to said contactor module means and mechanical connection means for mechanically connecting said power terminal module means to said overload module means.

12. A modular contactor system for controlling energization of a load for a power source, said system comprising:

a plurality of modular units including a contactor modular unit for selectively connecting said load to said power source, and at least two additional modular units each including means for providing a different additional function operatively associated with said contactor modular unit, said contactor modular unit and each of said additional modular units having plug-in connector means for selectively electrically connecting said modular units together in various arrangements, said plug-in connector means including a plurality of electrical connections for exchanging signals and for identifying one of said additional modular units to the other of said additional modular units and for sending information therebetween in order to function based on operational conditions in said system.

13. A modular contactor system of claim 12 wherein said at least two additional modular units are interchangeably connectable with said plug-in connector means on said contactor modular unit.

14. A modular contactor system for controlling energization of a load for a power source, said system comprising:

a plurality of modular units including a contactor modular unit for selectively connecting said load to said power source, and at least two additional modular units each including means for providing a different additional function operatively associated with said contactor modular unit, said contactor modular unit and each of said additional modular units having at least one plug-in connector having means for selectively mechanically externally connecting said modular units together and means for selectively electrically connecting said modular units together in various arrangements.

15. A modular contactor system of claim 14 wherein said plug-in connector means includes a plurality of electrical connections for electrically connecting said modular units together; and wherein said at least two additional modular units are interchangeably connectable with the same electrical connections on said contactor modular unit.

16. A modular contactor system of claim 14 wherein said plug-in connector means includes a plurality of electrical connections for exchanging signals and for identifying one of said additional modular units to the other of said additional modular units and for sending information therebetween in order to function based on operational conditions in said system.

17. A modular contactor system of claim 14 wherein said plug-in connector means includes a plurality of electrical connections for exchanging signals and for identifying one of said additional modular units to said contactor modular unit and for sending information between said one of said additional modular units and said contactor modular unit in order for said one of said additional modular units and said contactor modular unit to function based on operational conditions in said control system.

* * * * *